US005467683A

United States Patent [19]

Frey et al.

[11] Patent Number: 5,467,683

[45] **Date of Patent: * Nov. 21, 1995**

[54] ACTUATING DRIVE FOR A CONTROL VALVE

[75] Inventors: Heinz Frey, Menziken; Kamil Prochazka, Windisch; Franz Suter, Gebenstorf, all of Switzerland

[73] Assignee: ABB Management AG, Baden, Switzerland

[ * ] Notice: The portion of the term of this patent subsequent to Jul. 25, 2012, has been disclaimed.

[21] Appl. No.: 253,250

[22] Filed: Jun. 2, 1994

[30] Foreign Application Priority Data

Jun. 24, 1993 [DE] Germany ..... 43 20 937.8

[51] Int. Cl.[6] ..... F15B 13/04

[52] U.S. Cl. ..... 91/442; 91/447; 91/DIG. 3; 60/406

[58] Field of Search ..... 60/399, 403, 406, 60/477; 91/442, 447, DIG. 3

[56] References Cited

U.S. PATENT DOCUMENTS 2,204,270 6/1940 Dinzl ..... 91/442

4,589,444 5/1986 Masek ..... 91/437

FOREIGN PATENT DOCUMENTS

0430089A1 6/1991 European Pat. Off. .

2521193 11/1975 Germany .

*Primary Examiner*—F. Daniel Lopez

*Attorney, Agent, or Firm*—Burns, Doane, Swecker & Mathis

[57] ABSTRACT

This actuating drive (1) for a control valve (2) has a control circuit which sets the actuating drive (1) to correspond with a specified required value from an overriding installation control system. It has, in addition, a main piston (6) sliding in a main cylinder (5) with a drive volume (7), on one side of the main piston (6), which can be acted on in a controlled manner by oil under pressure and has a plate valve (17) fitted upstream of the drive volume (7).

The intention is to create an actuating drive, for a control valve, whose dynamic behavior can be improved by relatively simple means. This is achieved by the plate valve (17) being provided with a separate reservoir volume, connected to a drain appliance, for the oil emerging from the plate valve (17).

4 Claims, 3 Drawing Sheets

ACTUATING DRIVE FOR A CONTROL VALVE

BACKGROUND OF THE INVENTION

1. Field of the Invention

The invention relates to an actuating drive for a control valve.

2. Discussion of Background

An actuating drive for actuating a control valve by means of which, for example, the steam supply to a turbine of a power station installation is controlled has, connected to the actuation rod of the control valve, a main cylinder of a piston/cylinder arrangement, the main cylinder being acted on by spring force on one side and by oil under pressure on the other. When the pressure of the oil acting on the main piston in the opening direction decreases, the spring force reliably closes the control valve so that the steam supply is interrupted. This ensures that the turbine does not run out of control if the oil pressure should ever drop. The oil pressure in a drive volume is generated by an electrohydraulic converter; this oil pressure acts on the main piston and, by means of the latter, actuates the control valve. During a motion of the control valve in the opening direction, oil is fed under pressure into the drive volume but, because this motion takes place relatively slowly, relatively small cross-sections are sufficient for supplying the oil. A closing motion of the control valve, however, has to take place at a velocity which is approximately ten times higher. This involves emptying the drive volume relatively rapidly which, however, cannot be achieved through the small oil supply cross-sections.

In addition, it has been found that because of the increase in turbine powers, the control valves—and therefore also their actuating drives—must be made larger and more powerful. A corresponding proportional increase in the actuating drives leads to arrangements which require, for their actuation, relatively large quantities of oil under pressure. It is only with difficulty that commercial valves can still deal with such quantities of oil and, in addition, the dynamics of the actuating drive also suffer with increasing size.

An actuating drive with relatively better dynamics is known from the European Patent Application 0 430 089 A1. This actuating drive has a piston/cylinder arrangement in which a drive volume acted upon in a controlled manner by oil under pressure is arranged on one side of the main piston and an oil-filled buffer volume is arranged on the other side of the main piston. In this actuating drive, an oil flow from the drive volume is released by a plate valve, which is directly attached to the piston/cylinder arrangement, through a connecting conduit of large cross-section, which is directly attached to the piston/cylinder arrangement, into the buffer volume so that the control valve can be actuated very rapidly.

If the dynamics of an existing actuating drive have to be improved in association with retrofit work, a piston/cylinder arrangement has to be built completely anew for use with the existing actuating drive and this involves a relatively substantial complication. Furthermore, there is frequently no space available for the solution proposed in the European Patent Application 0 430 089 A1 so that other and more complicated solutions have to be employed.

SUMMARY OF THE INVENTION

Accordingly, one object of this invention is to provide a novel actuating drive for a control valve, the dynamic behavior of which actuating drive can be improved by relatively simple means.

The advantages achieved by the invention may be seen essentially in the fact that the actuating drive can be constructed so as to be relatively simple and operationally reliable, This actuating drive for a control valve has a control circuit which sets the actuating drive to correspond with a required value specified by an overriding installation control system. It has, in addition, a main piston sliding in a main cylinder with a drive volume on one side of the main piston, which drive volume can be acted on in a controlled manner by oil under pressure, and it has a plate valve fitted upstream of the drive volume. It has been found particularly advantageous for the plate valve to be provided with a separate reservoir volume connected to a drain appliance. In this way, the plate valve can be arranged at arbitrary positions in the region of the piston/cylinder arrangement of the actuating drive.

A connecting conduit is provided between the drive volume and the plate valve, which connecting volume opens through a connecting piece into a spring space of the plate valve.

It has been found particularly advantageous for the separate reservoir volume to be arranged concentrically around the spring space. In this way, the pressurized spring space and the seal locations of the plate valve are completely surrounded by volumes acted on by low pressure. If, due to a fault, oil should now escape at high pressure from the spring space, it escapes into the volumes mentioned so that secondary damage is avoided with great reliability.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which only represent one possible embodiment and wherein.

DESCRIPTION OF THE PREFERRED EMBODIMENTS

Figure 1:
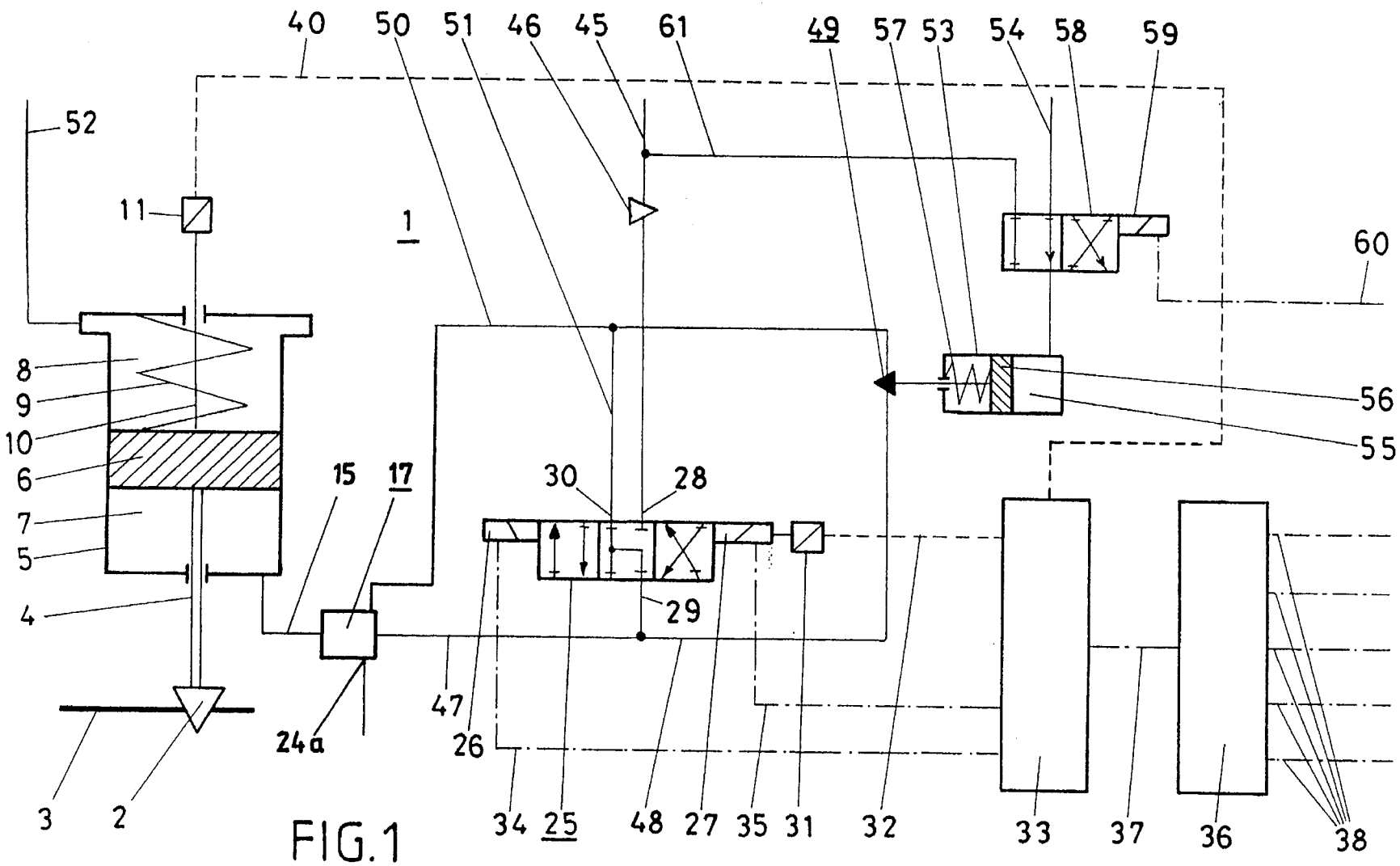
FIG. 1 shows a sketch of the principle of an actuating drive according to the invention.
Figure 1A:
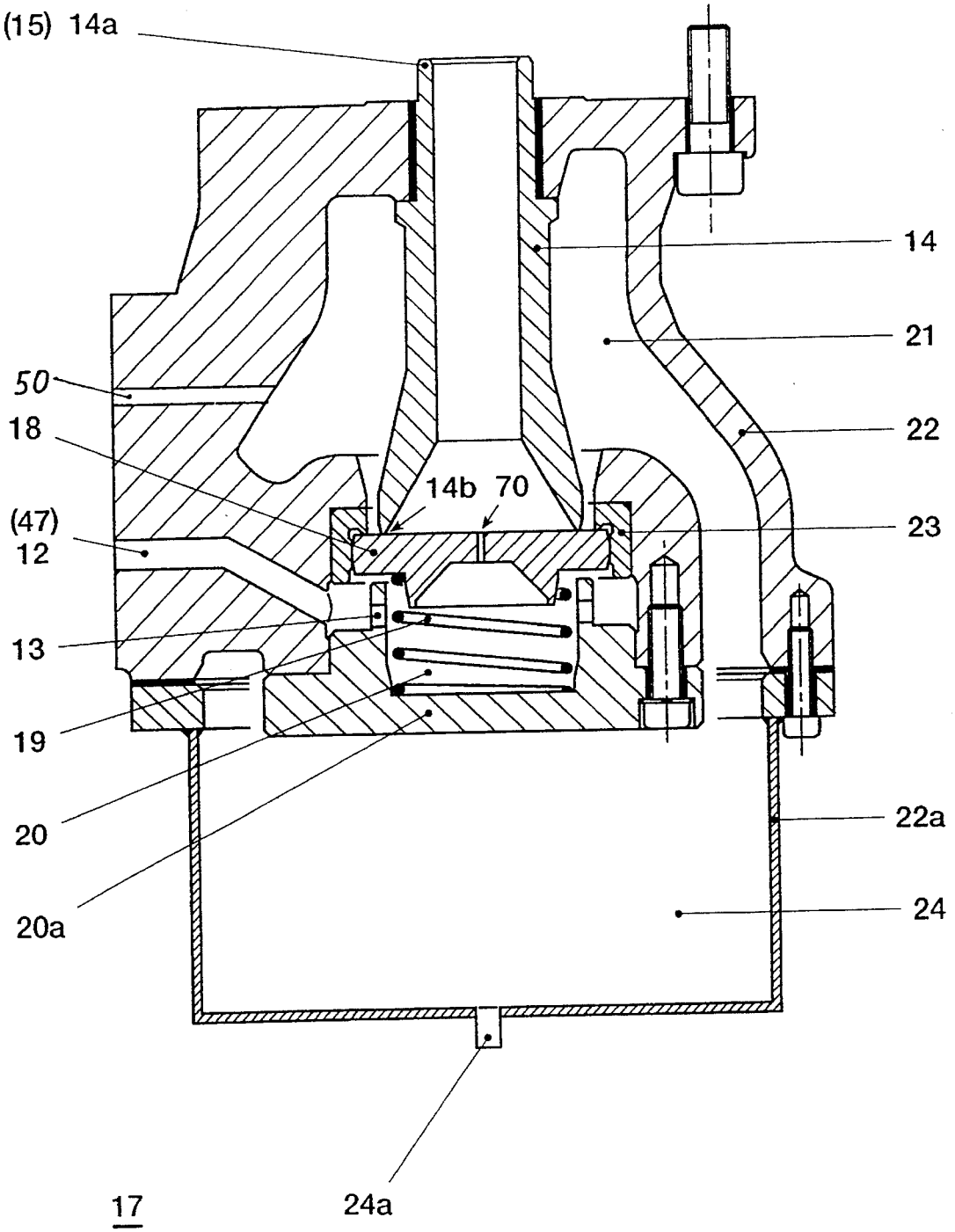
FIG. 1*a* shows a detail of the actuating drive according to the invention shown in FIG. 1.

Referring now to the drawings, wherein like reference numerals designate identical or corresponding parts throughout the several views and where, for improved clarity, visible edges are omitted in FIG. 1*a*, FIG. 1 shows an actuating drive 1 which actuates a control valve 2 which, in turn, controls the live steam quantity flowing through a live steam conduit 3 to a turbine (not shown). The control valve 2 is connected by a valve spindle 4 to a main piston 6 sliding in a main cylinder 5. A drive volume 7, which is acted on by oil under pressure, is arranged beneath the main piston 6. A different hydraulic fluid or a gaseous medium can also be provided instead of the oil. An oil-filled buffer volume 8 is provided above the main piston 6 and a spring 9, which acts against the oil pressure in the drive volume 7, is also arranged in the buffer volume 8. A conduit 52 leads from the buffer volume 8 to a drain appliance (not shown). A rod 10 is provided on the spring side of the main piston 6 and connects the same to a displacement measuring device 11. The displacement measuring device 11 monitors the stroke of the main piston 6 and continually reports its position, as is indicated by an influence line 40, to a position controller 33. The rod 10 and the valve spindle 4 penetrate the main cylinder 5 at opposite ends. The design of these pressure-tight lead-throughs is known and does not need to be further described here. The displacement measuring device 11 can also be applied directly to the valve spindle 4 outside the main cylinder 5.

A connecting conduit 15, which has a relatively large cross-section and which connects the drive volume 7 of the main cylinder 5 to a plate valve 17 arranged spatially separately from the main cylinder 5, is connected to the latter in the end face region of the drive volume 7. The plate valve 17 is represented in somewhat more detail in FIG. 1*a*. The plate valve 17 has a housing 22 which is closed at one end by a cap 22*a*. This cap 22*a* surrounds an intermediate volume 24. In the cap 22*a*, a drain connection 24*a* is provided to which is connected a conduit which connects the intermediate volume 24 to a drain appliance (not shown) for the oil. A connecting piece 14 is introduced in a pressure-tight manner into this housing 22. The plate valve 17 is flanged onto a connection flange (not shown) of the connecting conduit 15 in such a way that one end 14*a* of the connecting piece 14 is connected in a pressure-tight manner to the connecting conduit 15. The tubular connecting piece 14 has, at the other end, a cylindrically shaped seal seat 14*b*. The plate valve 17 has a plate 18, provided for example with an orifice 70, which plate 18 is pressed by a compression spring 19 against the seal seat 14*b* and, simultaneously, against a seal part 23 let into the housing 22. In the closed condition, the plate 18 prevents the emergence of oil from the spring space 20 into a volume .21 concentrically surrounding the connecting piece 14. The volume 21 merges into the intermediate volume 24. These two volumes concentrically surround the spring space 20 and the seal locations of the plate valve 17. The spring space 20, which is acted on by oil under pressure in the operating condition shown, is closed off from the intermediate volume 24 by means of a spring space cover 20*a*. The plate 18 is shaped in such a way that jamming of the same is excluded. The compression spring 19 is arranged in a spring space 20 which is acted on by oil under pressure through a hole 12 and an opening 13. The spring space 20 is made smaller than the drive volume 7, with which it is in effective connection, by an order of value of approximately 1000. The spring space 20 is, furthermore, in effective connection with a proportional directional valve 25 via a conduit 47.

The directly actuated proportional directional valve with positional control of type KFDG 4V-3/5, Series 20, of Vickers Systems GmbH, D6380 Bad Homburg v.d.H. can, for example, be used as the proportional directional valve 25. The proportional directional valve 25 has two actuating magnets 26, 27 which interact with return springs (not shown) and, in the present case, has three hydraulic connections 28, 29, 30. In FIG. 1, the proportional directional valve 25 is represented in the so-called "fail-safe" position. The proportional directional valve 25 has a stroke measuring device 31, which is connected to a spool of the valve, measures the current position of the spool and, as is indicated by an influence line 32, relays this information into a position controller 33 with an integrated power amplifier. As is indicated by the influence lines 34, 35, the actuating magnets 26, 27 receive their instructions from this position controller 33 with an integrated power amplifier. Furthermore, the position controller 33 has an input for feeding in an electrical signal supplied by the displacement measuring device 11, as is indicated by the influence line 40. A power amplifier EEA-PAM-533-A, Series 20, of Vickers Systems GmbH, D 6380 Bad Homburg v.d.H, which is specially matched to the proportional directional valve 25, can for example be employed as the position controller 33. This position controller 33 interacts with an overriding controller 36, as is indicated by an influence line 37. The controller 36 has further inputs 38 through which are fed information and instructions from an overriding installation control system which controls the complete power station installation.

Oil under pressure is fed in through a conduit 45 and the necessary oil pressure is generated by a pump (not shown). In some special cases, the oil flow quantity is limited to a maximum quantity by an orifice 46 arranged in the course of the conduit 45. As a rule, however, the oil flow quantity is limited by an orifice 70 provided in the plate 18 of the plate valve 17 so that the orifice 46 can then be omitted. The conduit 45 leads to the connection 28 of the proportional directional valve 25 which, in the representation of FIG. 1, is not connected through to the connection 29. The connection 29 is connected, on the one hand, to a conduit 47 which is in turn connected to the hole 12 which leads into the spring space 20 of the plate valve 17 and, on the other hand, is connected to a conduit 48 which leads to a safety valve 49, which is closed in the normal case and is configured as a plate valve. After the safety valve 49, a conduit 50 leads into the intermediate volume 24 of the plate valve 17. The last part of the conduit 50 is represented in FIG. 1*a* as a hole penetrating the wall of the housing 22. A conduit 51 branches off from the conduit 50 and makes the connection with the connection 30 of the proportional directional valve 25. The conduits 50 and 51 are configured as holes in the housing 22. This is possible because both the proportional directional valve 25 and the safety valve 49 are flanged directly and in a pressure-tight manner onto the housing 22 with the result that there is a monolithic valve block. A drain connection 24*a* leads from the intermediate volume 24 into a conduit which leads to a drain appliance (not shown). From this drain appliance, the oil again reaches the conduit 45 by means of the pump already mentioned.

The safety valve 49 is configured as a plate valve having a cylinder 53, a volume 55 which is acted on by oil under pressure from a safety oil circuit through a conduit 54, which volume 55 is bounded by a valve plate 56, and having a valve spring 57 which acts against the oil pressure acting on the valve plate 56. The fact that the valve plate 56 is designed in such a way that jamming of the same is impossible is not visible from the diagrammatic representation of the safety valve 49. In the normal case, the conduit 54 leads through a directional valve 58 and connects the latter to the volume 55. The directional valve 58 is actuated by an electromagnet 59. An influence line 60 indicates the path of the initiation instruction for the electromagnet 59.

Particularly advantageous effects appear where the plate valve 17 can be used in all installations independent of the type of the respective main cylinder 5. The conduit 15 can, as a rule, be made relatively short so that the oil-filled conduit volume is correspondingly small with an advantageous improvement to the dynamics. It is, however, also possible to provide one or a plurality of other valves in addition to the plate valve 17 where this appears desirable from the operating requirements placed on the actuating drive 1. Similarly, it is possible to replace the proportional directional valve 25 by at least one electrohydraulic valve or by a combination of different electrohydraulic valves in order to match the actuating drive and its dynamic behavior to the specified operating conditions. The actuating drive can, in consequence, be very flexibly employed.

The interaction of the position controller 33 with an integrated power amplifier and the controller 36 as a common electronic control arrangement of a control circuit is particularly advantageous because the position controller 33 is specially matched to the proportional directional valve 25 so that no additional matching and balancing are necessary. It is, however, quite possible to compose this electronic control arrangement from other elements or to shift their function into an overriding installation control system if, for example, the protection concept of the power station installation should require this. In the electronic control arrangement, signals derived from the displacement measuring device 11 and the stroke measuring device 31 are continually processed, together with at least one required value specified by the overriding installation control system in accordance with specified logic. In the case of deviations from this required value, this control arrangement generates correction signals which act on the actuating magnets 26, 27 of the proportional directional valve 25 and effect an appropriate control of the same.

Figure 2:
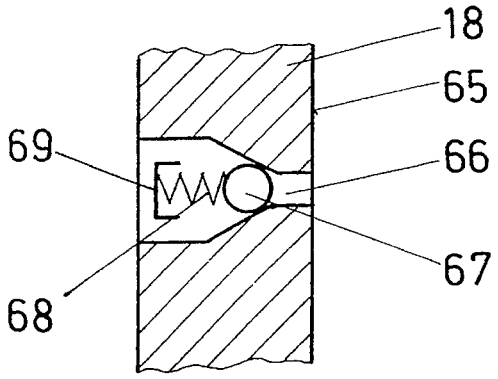
FIG. 2 shows a first configuration of a detail of a plate valve.

A part of the plate 18 of the plate valve 17 is represented diagrammatically in section in FIG. 2. The surface 65 on the spring-space side of the plate 18 is arranged on the right; this also applies to the following Figures. A penetration through the plate 18 has a cylindrical opening 66 which adjoins a conical widening. A ball 67 is pressed into this conical widening by a spring 68, which is supported against a holder 69 connected to the plate 18, and the ball 67 closes the opening 66. Oil under pressure can flow through the opening 66 into the connecting piece 14 and through the latter and on through the connecting conduit 15 into the drive volume 7 as soon as a pressure difference appears which is large enough to overcome the force of the spring 68 and the oil pressure acting on the ball 67.

Figure 3:
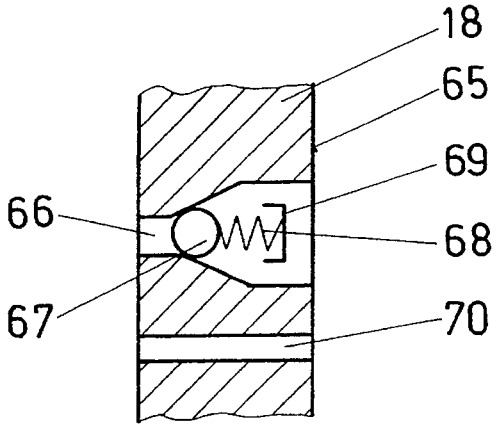
FIG. 3 shows a second configuration of a detail of a plate valve.

FIG. 3 is similar to FIG. 2 but in this case, a penetration with the opening 66 through the plate 18 is designed in such a way that oil from the drive volume 7 can flow through the connecting conduit 15 and through the connecting piece 14 into the spring space 20. In addition, there is also a fixed orifice 70 which permits a flow of oil in both directions. The cross-section of the orifice 70 is, in this case, designed to be much smaller than that of the opening 66.

Figure 4:
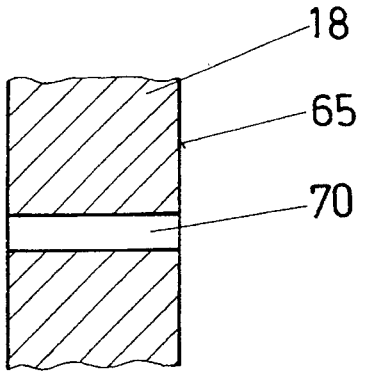
FIG. 4 shows a third configuration of a detail of a plate valve.

It is, of course, also possible—as is shown by FIG. 4—to introduce only one fixed orifice 70 as a penetration in the plate 18 and to limit the passage of oil by means of this orifice.

Figure 5:
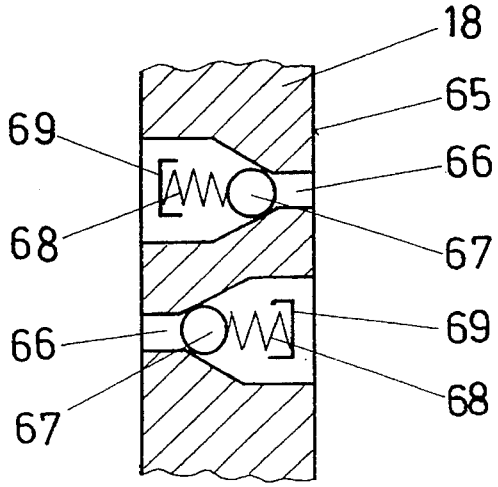
FIG. 5 shows a fourth configuration of a detail of a plate valve.

FIG. 5 shows a plate 18 with two valve arrangements, which are similar to those shown in FIG. 2 but permit the passage of oil in mutually opposite directions in the case of appropriate differential pressure. The opening 66 which leads from the drive volume 7 into the spring space 20 has a substantially larger cross-section than the second opening 66.

To explain the mode of operation, FIG. 1 is considered in more detail. The control valve 2 must be closed relatively rapidly in operation. The closing velocity in the normal case is in the range around 1 m/see but velocities which are only in the range around 0.02 m/sec are, on the other hand, demanded as the opening velocity. These velocity data are guidelines and substantial deviations from these data could also appear as a function of the design of the power station installation. The actuating drive 1 can be matched to the particular operating conditions with relatively little complication. If the control valve 2 has to be moved in the opening direction, the proportional directional valve 25 is actuated by the position controller 33 and, specifically, it is activated in such a way that the diagram to the left of the position shown applies. The connections 28 and 29 are then connected through and oil under pressure flows from the conduit 45 through the proportional directional valve 25. In normal operation, no oil can flow through the conduit 48 because the safety valve 49 closes this conduit 48. The oil flows through the conduit 47, the hole 12 and the opening 13 into the spring space 20 of the plate valve 17 and on from there through the penetration of the plate 18, through the connecting piece 14 and through the connecting conduit 15 into the drive volume 7. The oil pressure in the drive volume 7 moves the main piston 6 upward and therefore, via the valve spindle 4, moves the control valve 2 in the opening direction. The displacement measuring device 11 monitors the stroke of the main piston 6 and continually reports its position, as is indicated by the influence line 40, to the position controller 33. As soon as the specified required value of the stroke is reached, the position controller 33 deactivates the proportional directional valve 25 so that the oil flow is interrupted. The stroke measuring device 31, whose signals are processed in the position controller 33, monitors the operating behavior of the proportional directional valve 25. The motion of the main piston 6 is ended at the same time as this deactivation.

If, on the other hand, the control valve 2 has to be transferred rapidly from an open position into a closed condition, the proportional directional valve 25 is switched over in such a way that the diagram to the right of the position shown applies. The connections 29 and 30 are connected together and oil from the spring space 20 flows away through the conduit 47, through the proportional directional valve 25, through the conduits 51 and 50 and on through the buffer volume 8 and the conduit 52 into the drain appliance. This flow procedure, however, only lasts for a very short time because as soon as the pressure in the spring space 20 is smaller than the pressure in the drive volume 7, the plate 18 moves down against the pressure of the spring 19 and the oil from the drive volume 7 can flow away into the volume 21 and the intermediate volume 24 and from there on into the drain appliance. The spring 9 presses the main piston 6 downward and, therefore, presses the oil out of the drive volume 7 until the end position of the control valve 2 has been reached. The outflow of oil takes place very rapidly because the cross-section released by the plate valve 17 is relatively large so that the flow process is not negatively influenced by it.

Such rapid pressure relief of the drive volume 7 and such rapid draining of the oil from the same would not be possible through the relatively small cross-sections of the conduits 47, 51 and 50. If these cross-sections and the proportional directional valve 25 were to be correspondingly enlarged, it would not be even approximately possible to achieve such good dynamics of the actuating drive 1 as that achievable with the embodiment according to the invention because of the large oil quantities to be moved along relatively long paths.

Only a relatively small quantity of oil under pressure is required for action on the spring space 20 which is very small compared with the drive volume 7. This spring space 20 can also, therefore, be pressure-relieved very rapidly through the conduits 47, 51 and 50 when a corresponding control instruction reaches the proportional directional valve 25. The result of this is that the plate valve 17 has already opened immediately after the control instruction and introduced the rapid closing motion of the main piston 6 and therefore of the control valve 2. The volume of the conduits 47, 51, 50 does not therefore influence the dynamics of the actuating drive or only influences it negatively to an extremely small extent.

In normal operation, small deviations from the required value are recognized by the controller 36 and corresponding correction signals are transmitted via the position controller 33 to the proportional directional valve 25. If the control valve 2 should still open somewhat, only a small quantity of oil under pressure is added to the drive volume 7 until the required value has been reached again. The at least one penetration through the plate 18—such as is represented diagrammatically in FIG. 2 by the opening 66, in FIG. 3 and FIG. 4 by the orifice 70 and in FIG. 5 by the upper opening 66—is sufficient for opening motions of the control valve. If the plate 18 is configured in accordance with FIG. 2, the closing motion of the control valve is introduced, as already described, by a reduction of the oil pressure in the spring space 20 whereupon, when only a small stroke has to be made in the closing direction, the plate valve 17 only opens briefly and only permits oil to escape briefly into the volume 21 and the intermediate volume 24. As soon as the required value is reached, the plate valve 17 shuts again immediately.

In the case of the embodiment of the plate 18 in accordance with FIG. 3, small closing motions can take place without the plate valve 17 opening because oil can flow away from the drive volume 7 through the opening 66 and through the orifice 70 into the spring space 20 until a pressure balance is produced—as soon as the required value is reached. If it is necessary to compensate for larger required value deviations in this case, the plate valve 17 also opens briefly if the cross-sections of the opening 66 and the orifice 70 are not sufficient. The course of the closing process takes place in the case of the embodiment according to FIG. 4 in a manner similar to that in the embodiment in accordance with FIG. 3.

The embodiment of the plate 18 in accordance with FIG. 5 likewise permits a small closing motion and, for larger strokes of the main piston 6, opening of the plate valve 17 is again necessary in this case.

In FIG. 1, the proportional directional valve 25 is shown in the central position. It takes up this position if, for example, the actuating magnets 26, 27 should receive no voltage due to a mains failure. The attainment of this position is ensured under all circumstances by spring force from springs provided within the proportional directional valve 25. In this position, the spring space 20 is pressure-relieved by the conduits 47, 51 and 50 so that the plate valve 17 opens and this, as already described, leads to a rapid closing of the control valve 2. This ensures that the control valve 2 is always definitely closed even in the case of a fault so that under no circumstances can damage occur to the turbine which is being operated because of a defect in the actuating drive 1.

In the normal case, the safety valve 49 prevents a drop of pressure in the conduit 48 in the direction of the drain appliance. If, however, the pressure in the safety oil circuit falls, the pressure in the volume 55 also falls and the safety valve 49 releases the conduit 48 independent of the position of the proportional directional valve 25 so that the pressure can escape from the spring space 20 of the plate valve 17 via the conduits 47, 48 and 50 so that, as already described, a rapid closing process of the control valve 2 is initiated. This measure also permits the steam supplied to the turbine to be reliably shut off in any event.

During commissioning tests, it can happen that the safety oil circuit has not yet been put under pressure or cannot yet be put under pressure. The directional valve 58 is installed for this case and, as soon as the directional valve 58 is switched over electromagnetically to the diagram represented to the right of the position shown, this permits oil under pressure from the conduit 45 to act on the volume 55 through the conduit 61 and through the directional valve 58 so that the safety valve 49 is closed. The instruction path of the directional valve 58, as is indicated by the influence line 60, must however be blocked as soon as the system is switched over to normal operation because, otherwise, action by the safety oil circuit on the safety valve 49 may no longer be possible so that the protective function of this circuit would no longer be ensured.

If an older actuating drive is to be brought up to standard dynamically and from the point of view of safety, it is sensible to combine the plate valve 17, the proportional directional valve 25 and the safety valve 49 into a monolithic unit. This unit can then be mounted wherever sufficient space is available in the region of the piston/cylinder arrangement of the actuating drive.

The pressurized spring space 20 and the seal positions of the plate valve 17 are completely surrounded by volumes acted upon by low pressure. If, in the case of a defect, oil under high pressure should escape-from the spring space 20, it escapes into the said volumes so that secondary damage is avoided with a high level of reliability.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An actuating drive for a control valve, the control valve having a control circuit for setting the actuating drive to correspond with a specified required value from an overriding installation control system, the actuating drive comprising:

a main cylinder;

a main piston slidably disposed in the main cylinder, the main piston and the main cylinder defining a drive volume on a first side of the main piston, and a buffer volume on a second side of the main piston, the buffer volume being connected with a drain appliance;

a plate valve fitted upstream of the drive volume, the plate valve being arranged in a spatially separate manner from the drive volume and being connected to the drive volume by a connecting conduit, the plate valve having a reservoir volume, the reservoir volume including a first volume and an intermediate volume connected directly to the drain appliance, wherein pressurized fluid causes the main piston to slide in the main cylinder.

2. The actuating drive as claimed in claim 1, wherein the connecting conduit is connected to a cylindrical connecting piece, the connecting piece being closed off by a plate of the plate valve, the plate being provided with an aperture that connects a spring space of the plate valve with the connecting piece.

3. The actuating drive as claimed in claim 2, wherein the connecting piece is provided, on a side of the connecting piece facing the plate, with a seal seat.

4. The actuating drive as claimed in claim 3, wherein the reservoir volume is arranged concentrically around the seal seat.

* * * * *